US005829116A

United States Patent [19]

Vilon

[11] Patent Number: 5,829,116

[45] Date of Patent: Nov. 3, 1998

[54] METHOD OF TREATING A METAL SURFACE AND FOR MANUFACTURING A CULINARY ARTICLE

[75] Inventor: Jerome Vilon, Vulbens, France

[73] Assignee: SEB S.A., Ecully, France

[21] Appl. No.: 788,559

[22] Filed: Jan. 24, 1997

[30] Foreign Application Priority Data

Jan. 24, 1996 [FR] France ..... 96 00799

[51] Int. Cl.[6] ..... B05D 3/12; B21B 1/46

[52] U.S. Cl. ..... 29/527.2; 29/90.7; 76/101.1; 77/53; 427/271; 427/355; 216/52

[58] Field of Search ..... 76/104.1, 101.1; 451/38; 72/53; 427/375, 384, 385.5, 271, 275, 277, 307, 309, 348, 355, 369, 388.2, 388.5; 29/527.4, 424, 527.2, 90.7; 428/421, 35.8, 156, 161; 220/573.2, 62.13; 216/100, 39, 56, 52

[56] References Cited

U.S. PATENT DOCUMENTS

| | | | |
|---|---|---|---|
| 3,705,511 | 12/1972 | Brandel et al. | 72/53 |
| 4,066,817 | 1/1978 | DeRossi | 428/339 |
| 4,158,710 | 6/1979 | Gierek et al. | 427/310 |
| 4,426,411 | 1/1984 | Sasaki et al. | 427/349 |
| 4,454,740 | 6/1984 | Neal et al. | 72/53 |
| 4,607,512 | 8/1986 | Deville | 29/527.2 X |
| 4,894,959 | 1/1990 | Hoover | 451/38 |
| 5,463,916 | 11/1995 | Coudurier | 76/107.1 |
| 5,509,286 | 4/1996 | Coulon | 72/53 |
| 5,670,010 | 9/1997 | Hagiwara et al. | 156/330.9 |

FOREIGN PATENT DOCUMENTS

| | | | |
|---|---|---|---|
| 0 247 932 | 12/1987 | European Pat. Off. . | |
| 0 510 546 | 10/1992 | European Pat. Off. . | |
| 0 568 322 | 11/1993 | European Pat. Off. . | |
| 48111 | 11/1981 | Japan | 76/104.1 |
| 101613 | 6/1982 | Japan | 76/104.1 |
| WO 95/17994 | 7/1995 | WIPO . | |

*Primary Examiner*—Rinaldi I. Rada
*Assistant Examiner*—Boyer Ashley
*Attorney, Agent, or Firm*—Young & Thompson

[57] ABSTRACT

A method of treating a metal surface is disclosed wherein a series of microcavities is formed on the surface and a coating is applied to at least part of the surface. The surface is shot blasted using small balls projected against the surface. Applications include the manufacture of culinary receptacles.

10 Claims, 1 Drawing Sheet

METHOD OF TREATING A METAL SURFACE AND FOR MANUFACTURING A CULINARY ARTICLE

BACKGROUND OF THE INVENTION

1. Field of the invention

The present invention concerns a method of treating a metal surface. It also concerns a method of manufacturing a culinary article.

2. Description of the prior art

Creating a series of microcavities on a metal surface to enable the subsequent attachment of a coating, such as a polytetrafluoroethylene, for example, on that surface is known in itself.

These microcavities can be formed by chemical etching of the metal.

However, if the coating is applied to only part of the metal surface, in particular to form a decoration, some of the metal surface remains exposed. Because of the presence of the microcavities, the exposed surface is very porous and fragile and is therefore subject to soiling and scratching. It is then very difficult to clean these non-coated parts.

U.S. Pat. No. 5,463,916 discloses a method of preparing the surface to be coated by sand-blasting.

However, this method has the drawback that the microcavities formed in the metal become encrusted with grains of sand.

When the metal surface is coated, whether partly or totally, it is sometimes rolled or pressed in order to make the surface smooth and shiny.

An object of the present invention is to eliminate the drawbacks mentioned above by proposing a method of treating a metal surface in which the surface obtained is sufficiently smooth to prevent scratching and soiling by grease.

SUMMARY OF THE INVENTION

In a method in accordance with the invention of treating a metal surface:

a) a series of microcavities is formed on the surface, b) a coating is applied to at least part of the surface, and c) the surface is shot blasted using small balls projected against the surface.

By virtue of this shot blasting of the surfaces, the microcavities are crushed at the level of the metal surface. The moving balls rebound at the surface: at each impact with the surface the balls create an imprint and so crush the microcavities.

Soiling and sensitivity to scratching of the surface are therefore strongly reduced because of its increased hardness and smoothness.

The shot blasting step c) preferably follows the coating step b).

The shot blasting of the partial or total coating and of the exposed microcavities produces a surface that has a smooth appearance, is not very porous, is not very sensitive to scratching and is easy to clean.

When the coating is only partial, shot blasting the surface with small balls reaches areas of metal surface that are not coated and have exposed microcavities.

Shot blasting crushes the microcavities between the coated surface portions.

In a preferred version of the invention, in step b), the metal surface is partially coated with polytetrafluoroethylene.

The object of shot blasting is therefore to crush the exposed microcavities and to polish the polytetrafluoroethylene (PTFE) coating.

Unexpectedly, the PTFE coating does not lose its non-stick qualities after shot blasting but to the contrary has a smooth and shiny appearance making it easier to clean.

In another aspect, the invention consists in a method of manufacturing a culinary article from a metal plate having one surface with a continuous coating of polytetrafluoroethylene and another surface with a partial coating of polytetrafluoroethylene forming a decoration, wherein the two surfaces of the plate are treated by the treatment method of the invention.

This facilitates the manufacture of such culinary articles since the two faces of the vessel can be treated identically, simultaneously eliminating exposed microcavities and polishing the PTFE coating.

Other features and advantages of the invention will emerge from the following description and from the accompanying drawings, which are given by way of non-limiting example.

DETAILED DESCRIPTION OF THE PREFERRED EMBODIMENT

The treatment method of the invention is for treating a metal surface 1*a*, 1*b*, for example an aluminum or aluminum alloy surface.

It comprises the following steps:

a) A series of microcavities 4 is formed on the surface 1*a*, 1*b*.

Figure 2:
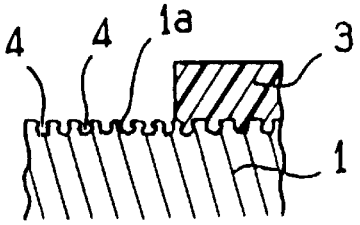
FIG. 2 is a view to a larger scale of the detail A in FIG. 1.

The microcavities 4 can be seen particularly clearly in FIG. 2. They are generally created by chemically etching the metal surface 1*a*, 1*b*.

b) A coating (2, 3) is then applied to at least part of the surface 1*a*, 1*b*.

The coating (2, 3) be a non-stick coating.

Figure 1:
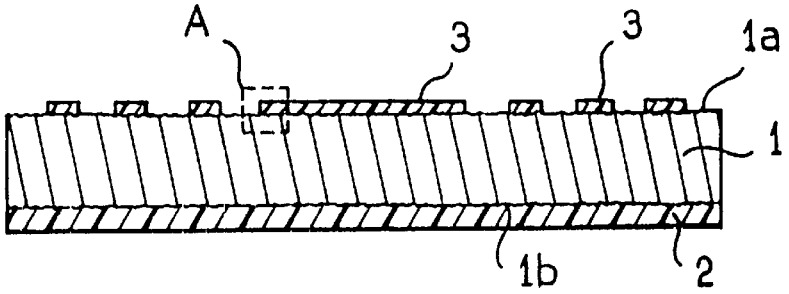
FIG. 1 is a cross-sectional view of a metal plate before treatment.

In the example described hereinafter, the coating is of polytetrafluoroethylene (PTFE). In FIG. 1, the surface 1*a* is partly coated to form a decoration and the surface 1*b* is continuously coated.

The PTFE may be applied by a roller or a spray gun or by silk screening, possibly using a screen or a mask to protect the non-coated areas of the metal surface 1*a*.

The surfaces 1*a*, 1*b* coated in this way are then cured for about 5 minutes at a temperature of 400° C. to 450° C.

As shown in FIG. 2, after steps a) and b) the surface 1*a* has non-coated areas with wide open microcavities 4 that can very easily become soiled.

In accordance with the invention, the treatment method further comprises a shot blasting step c) applied in the example to the already coated surface 1*a*, 1*b*.

The shot blasting step is carried out using small balls 7 projected against the surface 1*a*, 1*b*.

Figure 3:
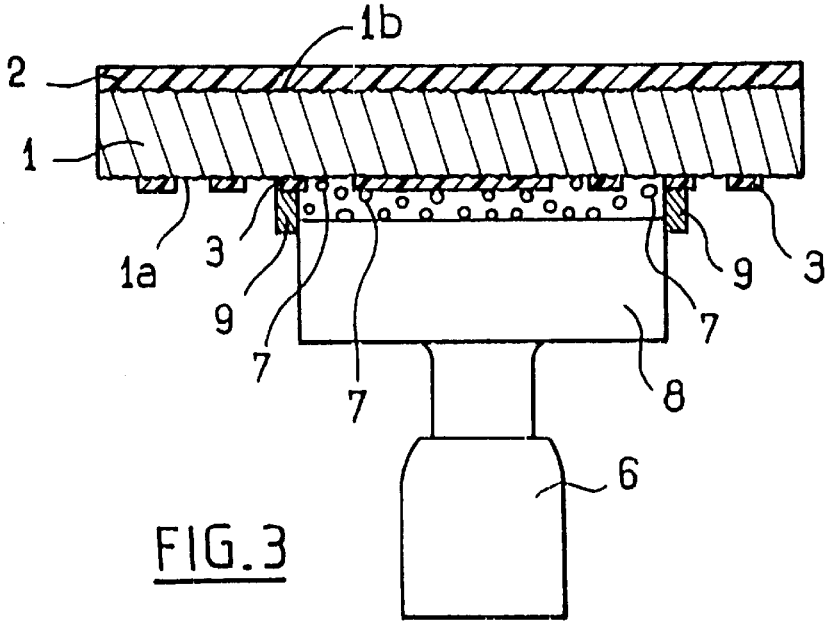
FIG. 3 is a view in cross-section of a metal plate during treatment in accordance with the invention.

This shot blasting step is shown in FIG. 3.

The balls 7 are made from a hard metal such as stainless steel.

They have a diameter between 0.5 mm and 5 mm so that they impact on small areas of the surface 1*a*.

The balls can all have the same diameter or different diameters.

The shot blasting step has a duration between 0.5 second and 5 seconds.

Movement is imparted to the balls 7 by ultrasound emitted by a generator 6.

The ultrasound generator 6 produces ultrasound waves that vibrate a sonotrode 8 (wave propagating along a vertical axis).

The ultrasound imparts movement to the balls 7 placed on the sonotrode 8, which are projected onto the surface to be treated.

The sonotrode may be of parallelepiped shape. To treat a surface in the shape of a disc, a circular mask 9 is placed on the surface to be treated.

Figure 4:
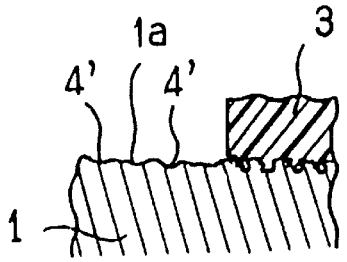
FIG. 4 is a cross-sectional view to a larger scale of a surface portion after shot blasting.

After shot blasting, the surface 1*a* has the microcavities 4' crushed by the balls 7, as shown in FIG. 4.

Figure 5:
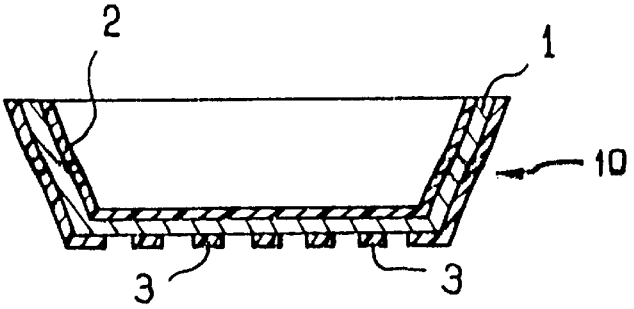
FIG. 5 is a cross-sectional view of a culinary receptacle obtained by the manufacturing method of the invention.

To manufacture a culinary article, such as a receptacle 10 shown in FIG. 5, the treatment method described hereinabove is applied to an aluminum plate 1, one face 1*a* being partially coated with PTFE to form a decoration and the other face 1*b* being entirely coated with PTFE.

The plate 1, in the shape of a disc, is then pressed into the shape of the culinary receptacle 10, the surface 1*a* partially coated with PTFE forming the exterior face of the receptacle 10.

Of course, many modifications may be made to the example described hereinabove without departing from the scope of the invention.

In the manufacture of a culinary receptacle, the shot blasting of the surfaces could equally well be carried out after pressing or flow turning of the coated metal plate.

I claim:

1. A method of treating a metal surface comprising the following sequential steps:

a) forming a series of microcavities on said surface;

b) applying a polytetrafluoroethylene coating to at least part of said surface; and c) shot blasting said surface by projecting small balls against such surface.

2. The method according to claim 1, wherein said balls are steel balls.

3. The method according to claim 1, wherein said balls have a diameter ranging between 0.5 mm and 5 mm.

4. The method according to claim 1, wherein said shot blasting step c) has a duration ranging between 0.5 second and 5 seconds.

5. The method according to claim 1, wherein movement is imparted to said balls by ultrasound emitted by a generator.

6. A method of manufacturing a culinary article which comprises the following sequential steps:

a) providing a metal plate having a first surface and a second surface;

b) forming a series of microcavities on each surface;

c) applying a continuous polytetrafluoroethylene coating to the first surface, and a partial coating of polytetrafluoroethylene to the second surface to form a decoration;

d) shot blasting each surface by projecting small balls there against; and e) pressing said plate into a shape of a culinary receptacle, with the partially coated second surface forming an exterior face of the receptacle.

7. The method according to claim 6, wherein said balls are steel balls.

8. The method according to claim 6, wherein said balls have a diameter ranging between 0.5 mm and 5 mm.

9. The method according to claim 6, wherein said shot blasting step c) has a duration ranging between 0.5 second and 5 seconds.

10. The method according to claim 6, wherein movement is imparted to said balls by ultrasound emitted by a generator.

* * * * *